US009356356B2

(12) United States Patent
Chang et al.

(10) Patent No.: US 9,356,356 B2
(45) Date of Patent: May 31, 2016

(54) TUNABLE SLOT ANTENNA

(75) Inventors: Chih-Hua Chang, New Taipei (TW); Yu-Kai Hung, New Taipei (TW)

(73) Assignee: Acer Incorporated, New Taipei (TW)

( * ) Notice: Subject to any disclaimer, the term of this patent is extended or adjusted under 35 U.S.C. 154(b) by 427 days.

(21) Appl. No.: 13/557,310

(22) Filed: Jul. 25, 2012

(65) Prior Publication Data

US 2013/0234901 A1 Sep. 12, 2013

(30) Foreign Application Priority Data

Mar. 8, 2012 (TW) ..... 101107827 A

(51) Int. Cl.
*H01Q 1/24* (2006.01)
*H01Q 13/10* (2006.01)
*H01Q 1/48* (2006.01)

(52) U.S. Cl.
CPC ..... *H01Q 13/103* (2013.01); *H01Q 1/243* (2013.01); *H01Q 1/48* (2013.01); *H01Q 13/106* (2013.01)

(58) Field of Classification Search
CPC ..... H01Q 13/00; H01Q 13/10; H01Q 13/103; H01Q 13/106; H01Q 1/243; H01Q 1/48
USPC ..... 343/745, 767, 768, 770, 746
See application file for complete search history.

(56) References Cited

U.S. PATENT DOCUMENTS 4,893,131 A 1/1990 Smith et al.
6,043,786 A * 3/2000 Vannatta ..... H01Q 1/38 343/700 MS
6,864,848 B2 * 3/2005 Sievenpiper ..... H01Q 9/14 343/767
7,176,842 B2 2/2007 Bettner et al.
7,372,406 B2 * 5/2008 Shiotsu ..... G06F 1/1616 343/700 MS
8,884,835 B2 * 11/2014 Pelosi ..... H01Q 1/243 343/702
2003/0122721 A1 7/2003 Sievenpiper
2003/0160728 A1 * 8/2003 Fukushima ..... H01Q 1/242 343/702
2004/0021605 A1 * 2/2004 Kouam ..... H01Q 1/38 343/700 MS
2005/0174294 A1 8/2005 Peroulis et al.
2008/0316118 A1 * 12/2008 Puente Baliarda ... H01Q 9/0421 343/702
2010/0060530 A1 * 3/2010 Shoji ..... H01Q 9/145 343/702
2015/0029068 A1 * 1/2015 Toyao ..... H01Q 1/2266 343/770

FOREIGN PATENT DOCUMENTS

CN 101243583 A 8/2008
DE 3246365 A1 6/1984

(Continued)

OTHER PUBLICATIONS

European Search Report, EP12192247, Jun. 21, 2013, 11 pages.

(Continued)

*Primary Examiner* — Dameon E Levi
*Assistant Examiner* — Jennifer F Hu
(74) *Attorney, Agent, or Firm* — Edell, Shapiro & Finnan, LLC

(57) ABSTRACT

An open slot antenna is formed in a planar conductor on a dielectric substrate. A tuning circuit is disposed toward an open end of the slot antenna and is used to select a resonant frequency of the antenna by electrically connecting one of multiple tuning elements across opposing sides of the slot. The tunable antenna so constructed may be incorporated into a handheld mobile communication device that can be operated in different geographic regions, each having different regional communication standards under which mobile communications are conducted.

18 Claims, 8 Drawing Sheets

(56) References Cited

FOREIGN PATENT DOCUMENTS

| | | | |
|---|---|---|---|
| EP | 1280226 | A1 | 1/2003 |
| EP | 1437794 | A1 | 7/2004 |
| TW | 1261950 | B | 9/2006 |
| TW | 201036253 | A | 10/2010 |
| WO | 2006114477 | A1 | 11/2006 |
| WO | 2007023442 | A2 | 3/2007 |
| WO | 2011055003 | A1 | 5/2011 |

OTHER PUBLICATIONS

Chen et al., "Frequency-Agile, Miniaturized Slot Antenna for Hand-Held Devices", IEEE, 2010, pp. 377-380.

Chinese Office Action, Sep. 23, 2014, 4 pages.

Chinese Search Report, Sep. 4, 2014, 2 pages.

Chen et al., "Frequency-Agile, Miniaturized Slot Antenna for Hand-Held Devices", 2010 URSI International Symposium on Electromagnetic Theory, (2010), pp. 377-380.

Taiwan Office Action, May 26, 2015, 3 pages.

Taiwan Search Report, May 28, 2015, 1 page.

CN Search Report, Jan. 15, 2016, 2 pages.

Chen et al., "Frequency-Agile, Miniaturized Slot Antenna for Hand-Held Devices", URSI International Syposium on Electromagnetic Theory, 2010, pp. 377-380.

CN Office Action, Jan. 28, 2016, 4 pages.

* cited by examiner

TUNABLE SLOT ANTENNA

RELATED APPLICATION DATA

This patent application claims priority under 35 USC §119 of Taiwan R.O.C. Patent Application No. 101107827 filed Mar. 8, 2012.

TECHNICAL FIELD

The present disclosure relates to mobile wireless communication device antennas.

BACKGROUND

Long Term Evolution (LTE) handheld communication devices continue to be developed with trends toward smaller devices and wider bandwidth operation. Size limitations of thin mobile devices present challenges for internal antenna design in LTE/2G/3G wideband operations. Operating a single device at different locations with distinct regionally-enforced communication standards presents additional challenges. This is clear from Table I, which illustrates possible LTE band distributions for the Evolved UMTS (Universal Mobile Telecommunications System) Terrestrial Radio Access (e-UTRA) radio access standard used in various geographical regions.

TABLE 1

| e-UTRA | Duplex Mode | Uplink Freq. Range | Downlink Freq. Range |
|---|---|---|---|
| Band IV | FDD | 1710-1755 (MHz) | 2110-2155 (MHz) |
| Band XIII | FDD | 777-787 | 746-756 |
| Band XVII | FDD | 704-716 | 734-746 |
| Band XX | FDD | 832-862 | 791-821 |
| Band XXXVIII | TDD | 2570-2620 | |
| Band XL | TDD | 2300-2400 | |

Slot antennas provide simple radiating structures for use in such mobile devices and various technologies for tuning slot antennas exist. For example, U.S. Pat. No. 7,176,842 entitled Dual Band Slot Antenna incorporates electronic components prudently distributed across the antenna slot to shunt the slot at certain locations, thereby changing the antenna's effective length. US Patent Application Publication 2005/0174294 entitled *Switchable Slot Antenna* discloses another technique by which the effective length of the antenna is changed by solid state shunt switches distributed across the slot antenna. Both of these techniques rely on the distribution of switches across the radiating slot, each of which requires its own control signals, e.g., bias voltages. The distributed nature of the tuning circuits of these antennas increases the size of the overall circuit. Moreover, both of the afore-referenced systems utilize a half-wavelength slot, which imposes mechanical limitations on the antenna and, thereby, on the size of the mobile device. The need for smaller tunable antennas for mobile communication devices continues to be felt.

SUMMARY

The present general inventive concept is directed to an antenna comprising a slot radiator formed in a planar conductor and having an open and a closed end. A tuning circuit is used to select a resonant frequency of the antenna. The tuning circuit is electrically coupled to the planar conductor at opposing sides of the open end of the slot and is configured to select a circuit path from a plurality of circuit paths. The tuning circuit may include a switch circuit and one or more sets of circuit elements including, for example, a capacitor, connected between the switch circuit and the slot. The circuit paths connect respective sets of circuit elements through the switch circuit to the opposing sides of the planar conductor.

DESCRIPTION OF EXAMPLE EMBODIMENTS

Figure 1:
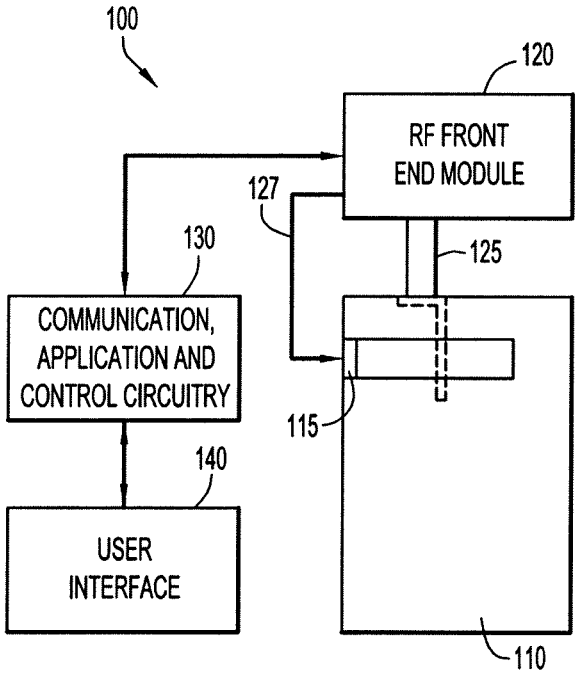
FIG. 1 is a schematic block diagram of an example mobile communication device by which the present general inventive concept may be embodied.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments.

FIG. 1 is a schematic block diagram of an exemplary mobile communication device 100, which may be, for example, an LTE-compliant mobile device. Mobile device 100 may include an antenna 110 that radiates and intercepts electromagnetic energy at a selected carrier frequency. Antenna 110 may be coupled to a radio-frequency (RF) front end module (FEM) 120 through a suitable transmission line connection 125. RF FEM 130 may convey communication data to and from suitable communication, application and control circuitry 130, which is, in turn, conveyed to and from antenna 110. Received communication data and communication data for transmission may be presented to and provided by user interface 140, by which a user interacts with other devices over a communication network and controls features of mobile device 100.

As will be described in more detail below, antenna 110 may be an open-end slot antenna having a tuning circuit 115, by which the resonant frequency of antenna 110 is modified to match a frequency band selected from a plurality of frequency bands for which mobile device 100 is designed. In certain embodiments, RF FEM 120 generates a control signal 127 in accordance with a selected carrier frequency. While control signal 127 is illustrated as being provided by RF FEM 120, the present invention is not so limited. Control signal 127 is provided to tuning circuit 115 in accordance with the selected carrier frequency, such as that in a band specified by a particular standard or protocol, such as the E-UTRAN radio access standard.

Figure 2:
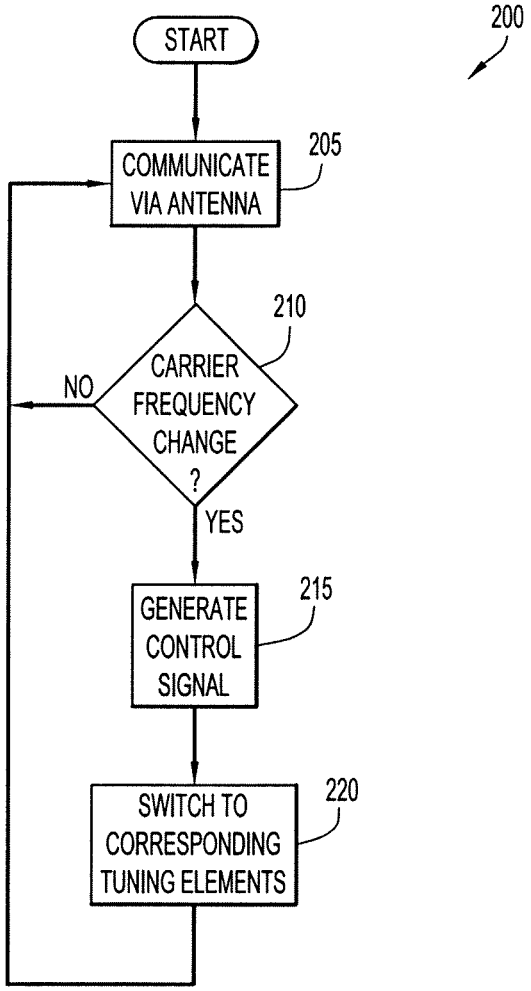
FIG. 2 is a flow diagram of an example tuning method for a slot antenna embodying the present general inventive concept

Tuning the antenna 100 may be performed via exemplary process 200 illustrated in FIG. 2. In operation 205, communications occur over antenna 110 in a particular band of frequencies. In this arbitrary initial state, antenna 110 is tuned by tuning circuit 115 to resonate at a resonant frequency in the currently selected frequency band. Such tuning may be achieved through a resonant circuit selected from a plurality of such circuits. It is to be understood that the term resonant circuit refers to a combination of circuit elements selected by tuning circuit 115 and the characteristic impedance of antenna 110. In operation 210 it is determined whether a change in carrier frequency is required for proper communication over a particular network. In certain instances, such frequency change is necessary to comply with regionally- and/or carrier-enforced communication standards. Accordingly, embodiments of the invention may include detection circuitry that detects a change in communication requirements and/or enforced standards in the performance of operation 210. Optionally or additionally, a user of mobile device 100 may manually switch the device into another operational mode, such as through suitable controls on user interface 140. The present invention is not limited to the manner in which embodiments of the present invention determine the requirement for changing communication parameters, such as the carrier frequency and/or operational frequency bands.

If it is determined in operation 210 that no change in carrier frequency is necessary, operation of mobile device 100 continues in the current operational mode in operation 205. If, however, it is determined that a change in carrier frequency is appropriate, control signal 127 is generated in operation 215 and provided to tuning circuit 115, by which the appropriate tuning circuitry is engaged in operation 220. Process 200 may then transition to operation 205, in which mobile device 100 communicates through the network at the selected carrier frequency.

Figure 3A:
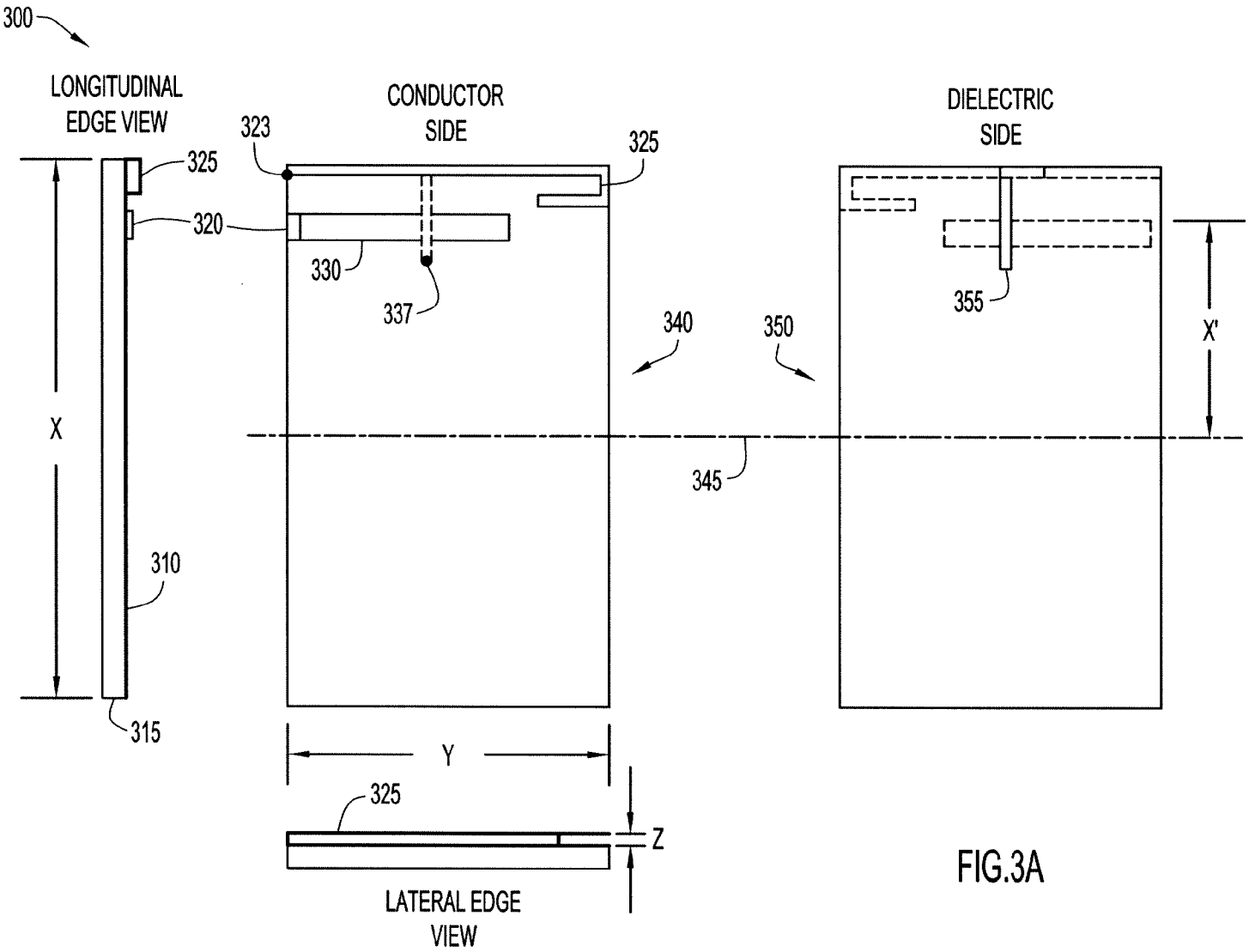
FIG. 3A is a diagram of an example slot antenna by which the present general inventive concept may be embodied.

FIG. 3A illustrates an exemplary antenna 300 consistent with the present invention. As illustrated in the figure, antenna 300 is a slot antenna comprising an open slot radiator 330, which may be referred to simply as slot 330, and a tuning circuit 320 to control the resonant mode of antenna 300. Slot 330 may be formed in a planar conductor 310, such as copper, disposed on a planar dielectric substrate 315, such as an FR-4 glass-reinforced epoxy laminate. Accordingly, antenna 300 may be described herein as comprising a conductor side 340 and a substrate side 350. Conductor 310 may be held at ground equipotential and, as such, may be referred to herein as ground plane 310. Conductor 310 and substrate 315 may be equally sized into a rectangular shape of longitudinal dimension X and lateral dimension Y. The position of slot 330, illustrated in FIG. 3A as distance X' measured from midline 345, will vary by application and may be constrained by other design factors, such as placement of other circuitry or mechanical structure in mobile device 100. To facilitate impedance matching in lower frequency bands to which antenna 300 may be tuned, a grounding strap 325 may be positioned between slot 330 and the nearest lateral edge of ground plane 310. In certain embodiments, ground strap 325 may be elevated by a distance Z from the surface of ground plane 310 and may be electrically connected to ground plane 310 at a predetermined grounding point 323. The elevation distance Z will vary by application, e.g., by the wavelength in the corresponding frequency bands and the location X' of slot 300.

As illustrated in FIG. 3A, antenna 300 is excited by an electromagnetic signal on feed line 355, where such electromagnetic signal may be provided to feed line 355 on transmission line 125 illustrated in FIG. 1. Feed line 355 may be a microstrip transmission line formed on substrate side 350 and terminated at ground conductor 310, such as via a through-hole from substrate side 350 to conductor side 340, by ground connection 337. The ordinarily skilled artisan will recognize various transmission line design techniques that may be used in conjunction with the present invention to ensure that feed line 355 is impedance-matched to transmission line 125 and to slot 330, and is positioned to properly excite slot 330 for radiating electromagnetic signals.

Figure 3B:
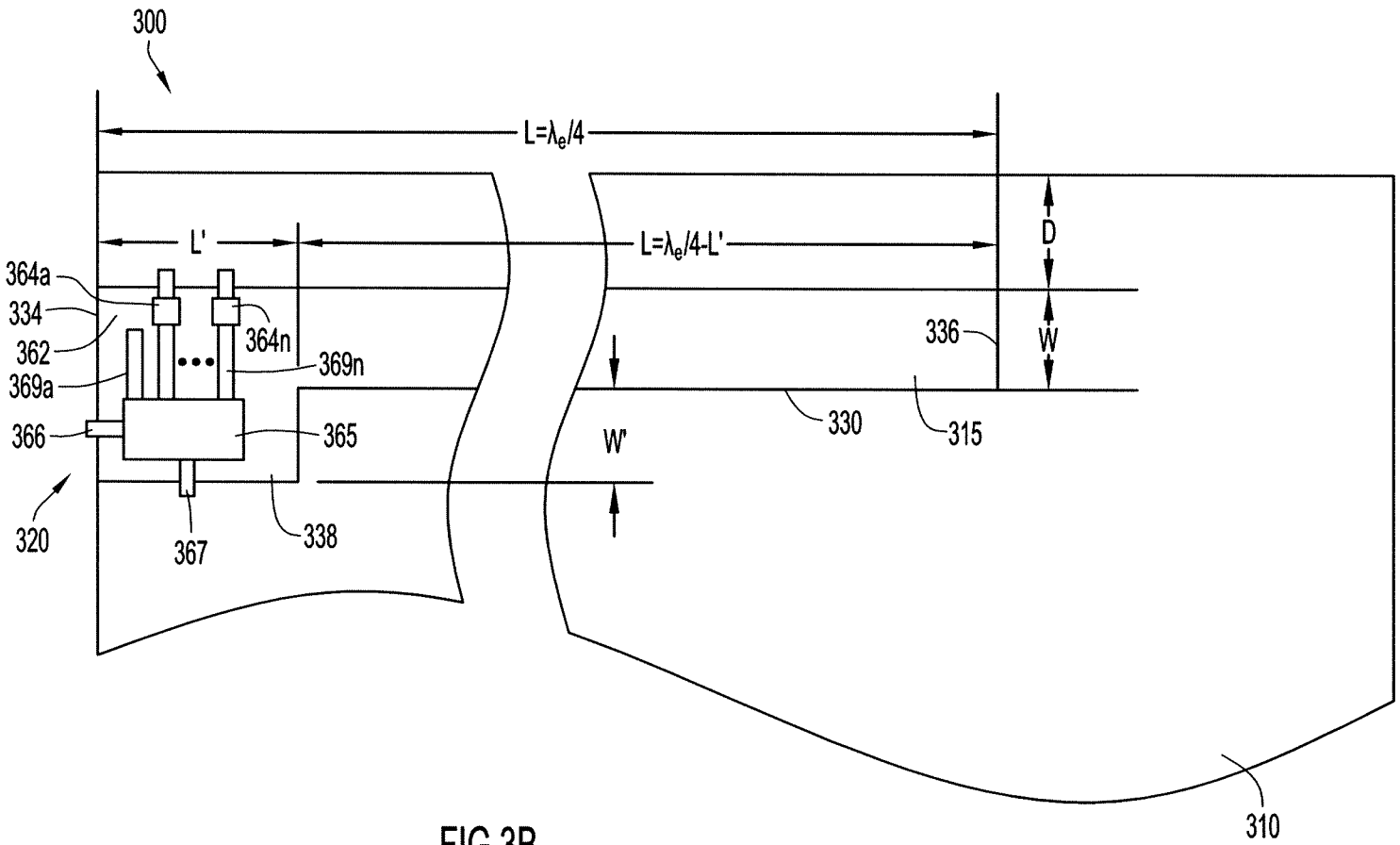
FIG. 3B is a diagram illustrating details of the slot antenna of FIG. 3A.

FIG. 3B illustrates slot 330 in more detail. Slot 330 is formed in ground plane 310 to expose the dielectric substrate 315 and includes an open end 334 and a closed end 336. The length L of slot 330 is one-quarter wavelength ($\lambda_e/4$), where $\lambda_e$ is an effective wavelength of the carrier signal taking into account the permittivity of dielectric substrate 315. For an FR-4 substrate, for example, $\lambda_e=0.468*\lambda_0$, where $\lambda_0$ is the free-space wavelength of the carrier signal. In certain embodiments, $\lambda_e$ is a design parameter that may be selected in accordance with the tunable range of slot 300. The width W of slot 330 is another such design parameter, while the distance D of slot 300 from the nearest lateral edge 312 of conductor 310 may be constrained by mechanical requirements in mobile device 100, as discussed above with reference to the distance X' in FIG. 3A.

Tuning circuit 320 may be positioned at the open end 334 of slot 330 and contained in a single region of length L' and width W+W'. That is, the tuning circuit does not extend into slot 330 beyond the containing L' by (W+W') region. Tuning circuit 320 may include an RF switch 365 and one or more tuning elements 364*a*-364*n*. The conductive path through RF switch 365 may be selected by one or more control signals 127 provided to one or more position selection terminals, representatively illustrated at position selection terminal 366. RF switch 365 may include a common terminal 367 electrically connected to ground plane 310 and a plurality of switched terminals 369*a*-369*n* electrically connected to tuning circuit elements 361*a*-361*n*, which, in turn, are series connected to ground plane 310.

Figure 4:
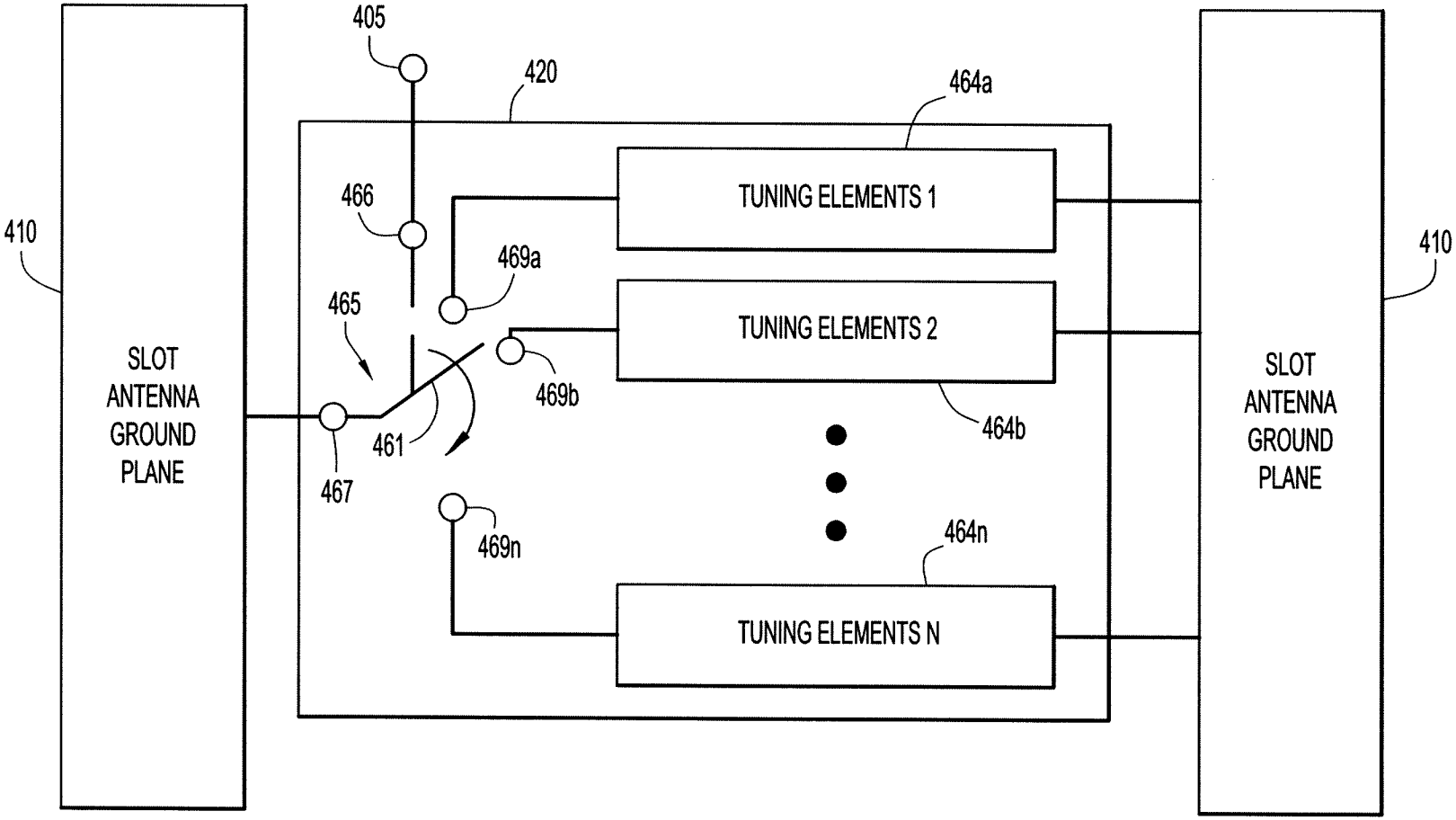
FIG. 4 is a schematic block diagram of an example antenna tuning circuit by which the present general inventive concept may be embodied.

FIG. 4 is a schematic block diagram of an exemplary tuning circuit 420 comprising RF switch 465 and tuning elements 464*a*-464*n*, representatively referred to herein as tuning element(s) 464. Tuning elements 464 may be individual discrete circuit components, such as, but not limited to, capacitors and inductors, or may be combinations of such circuit components that form individual tuning circuits. The ordinarily skilled artisan will recognize numerous implementations of tuning elements 464 that may be used without departing from the spirit and intended scope of the present invention.

As described with respect to FIG. 3B, common terminal 467 of switch 465 may be electrically connected to ground plane 410 and switched terminals 469*a*-469*n*, representatively referred to herein as switched terminal(s) 469, may be series connected to respective tuning elements 464, which are each terminated at ground plane 410. Each tuning element 464 may be configured to tune a resonant frequency of slot 330 to a corresponding target frequency, such as a prescribed carrier frequency in a communication frequency band, such as an e-UTRA band for a particular geographic region. Accordingly, slot 330 may be designed and constructed for a fixed operating frequency, which is then tuned for other operating frequencies by switching contacts 461 into a position that selects the appropriate tuning element 464. In certain embodiments, one of tuning elements 464 is an open circuit, as illustrated at position 362 in FIG. 3B, so that the operating frequency for which slot 330 is fixed may be selected as one of the target frequencies. When so embodied, slot 330 may be designed to correspond to, for example, the frequency carrier of a particular home geographical region, and tuning elements 464 may be selected to tune the resonant frequency of slot 330 to accommodate carrier frequencies in other geographical regions.

Upon a determination that antenna 300 is to be tuned to a particular frequency, a control signal, such as control signal 127, may be applied to tuning circuit control terminal 405 and a corresponding signal may be applied to position selection terminal 466 of RF switch 465. In response to the control signal, a conductive path, representatively illustrated by contact 461, is formed through the appropriate tuning element 464 to ground plane 410. It is to be understood that while RF switch 465 is illustrated as a mechanical single-pole, multiple-throw switch, such is solely for purposes of description. As such, RF switch 465 may not have contacts, per se, but rather semiconductors, such as PIN diodes or the like, to form the conductive path. The present invention is not limited to a particular implementation of RF switch 465 and, in a typical implementation, will be a solid state RF switch.

Returning to FIG. 3B, there is illustrated a region 338 at the open end 334 of slot 330. Region 338 is characterized by a broadening of slot 300 by a distance W' over a length L'. When the present invention is so embodied, portions of tuning circuit 320 may be contained in the L' by W' region 338 without extending into the remaining width W of slot 330 to minimize the impact of the tuning circuit 320 on the operation of antenna 300. For example, relatively large electrical components of tuning circuit 320, such as RF switch 365, may be contained in region 338 while relatively smaller components, such as small surface mounted capacitors and inductors, may reside in slot 330. In other embodiments, all circuit components other than conductive traces connecting tuning elements 364 to ground plane 310 are contained in broadened region 338. If the region defined in the L' by (W+W') rectangle in which tuning circuit 320 is contained is kept small with respect to wavelength $\lambda_0$, e.g., $L'=\lambda_0/40$, the impact on the operation of antenna 300 is minimal and can be compensated for by, for example, suitably selecting tuning elements 364 to account for such impact.

Figure 5A:
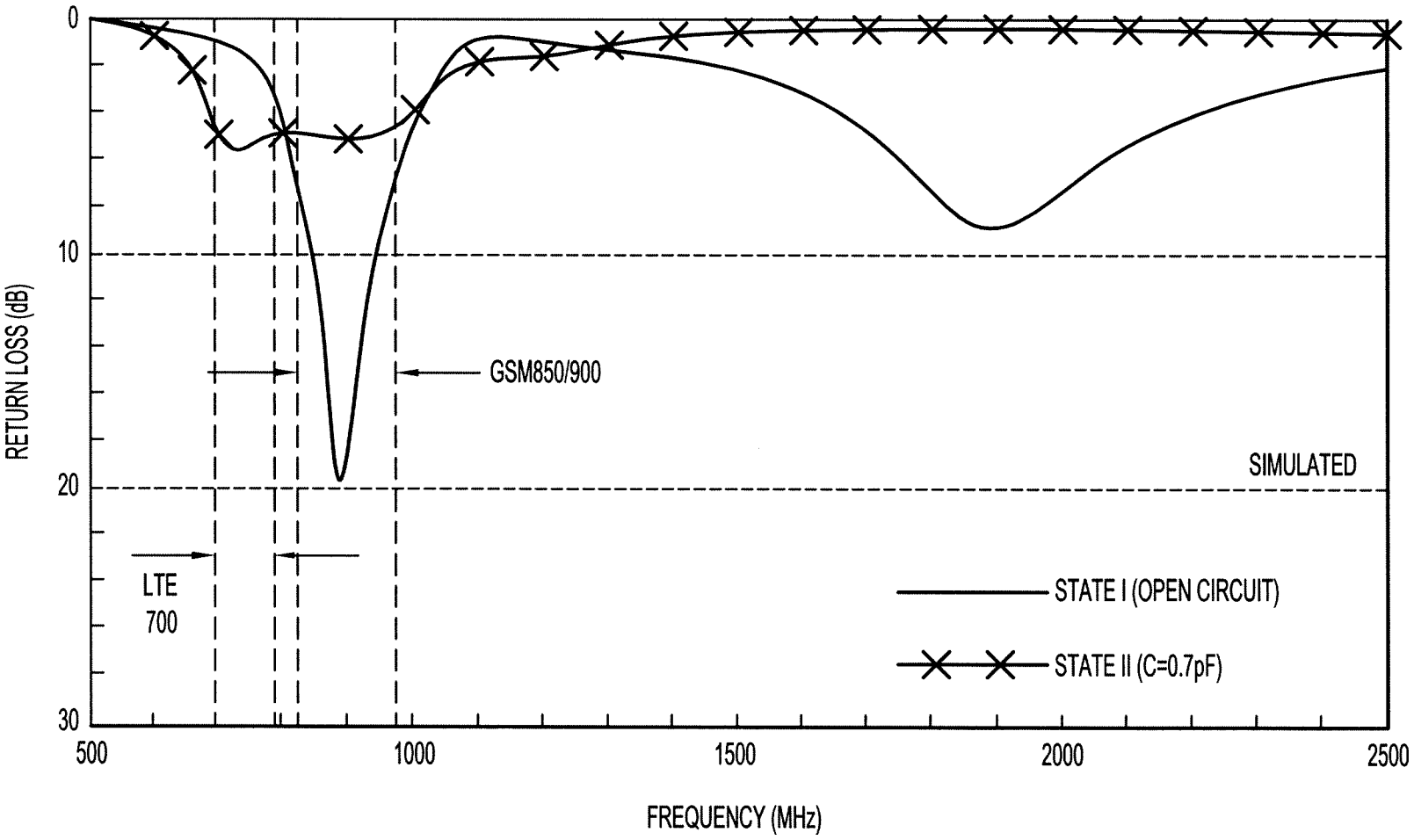
FIGS. 5A-5C are graphs depicting electrical characteristics of a particular slot antenna embodying the present general inventive concept.
Figure 5B:
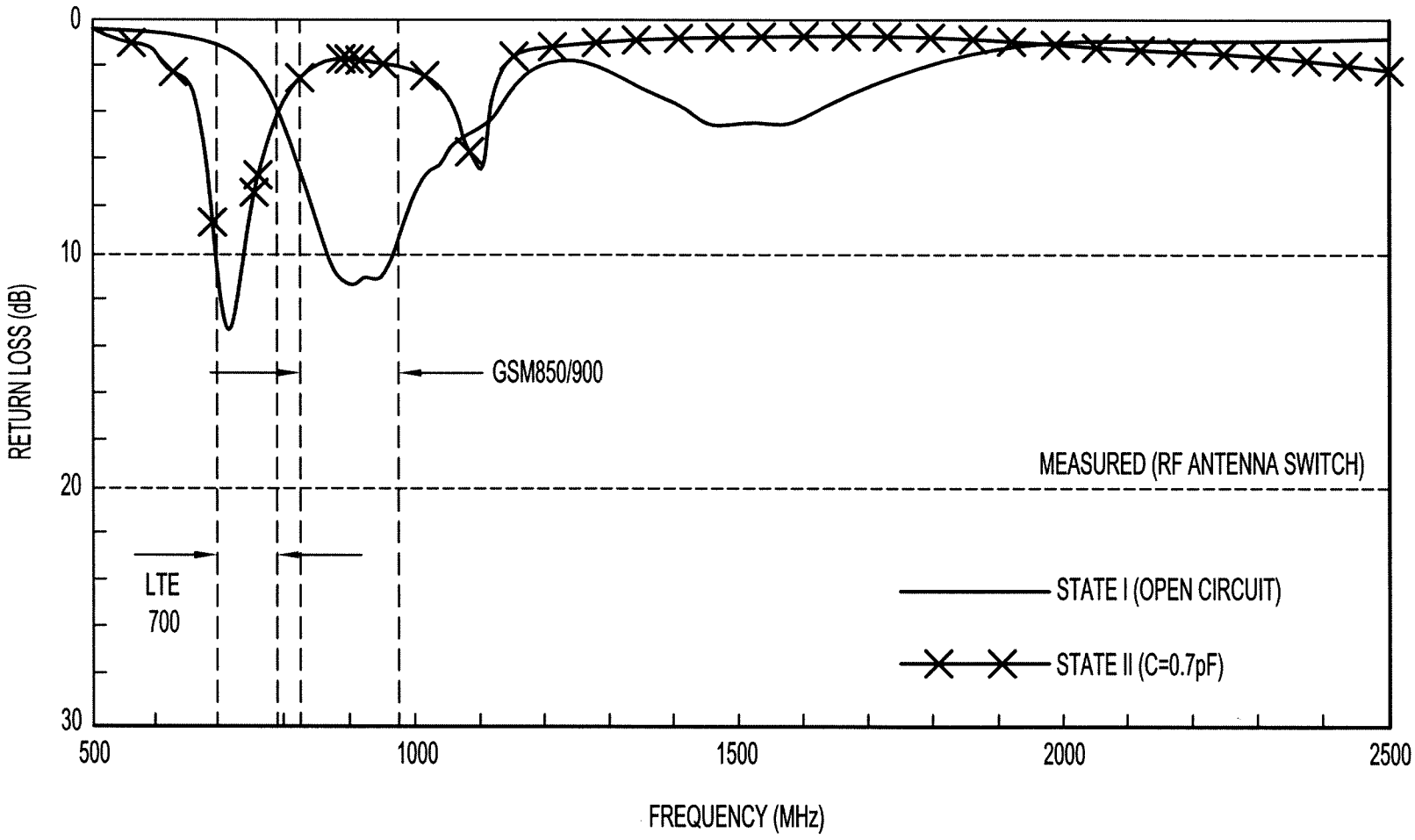
Figure 5C:
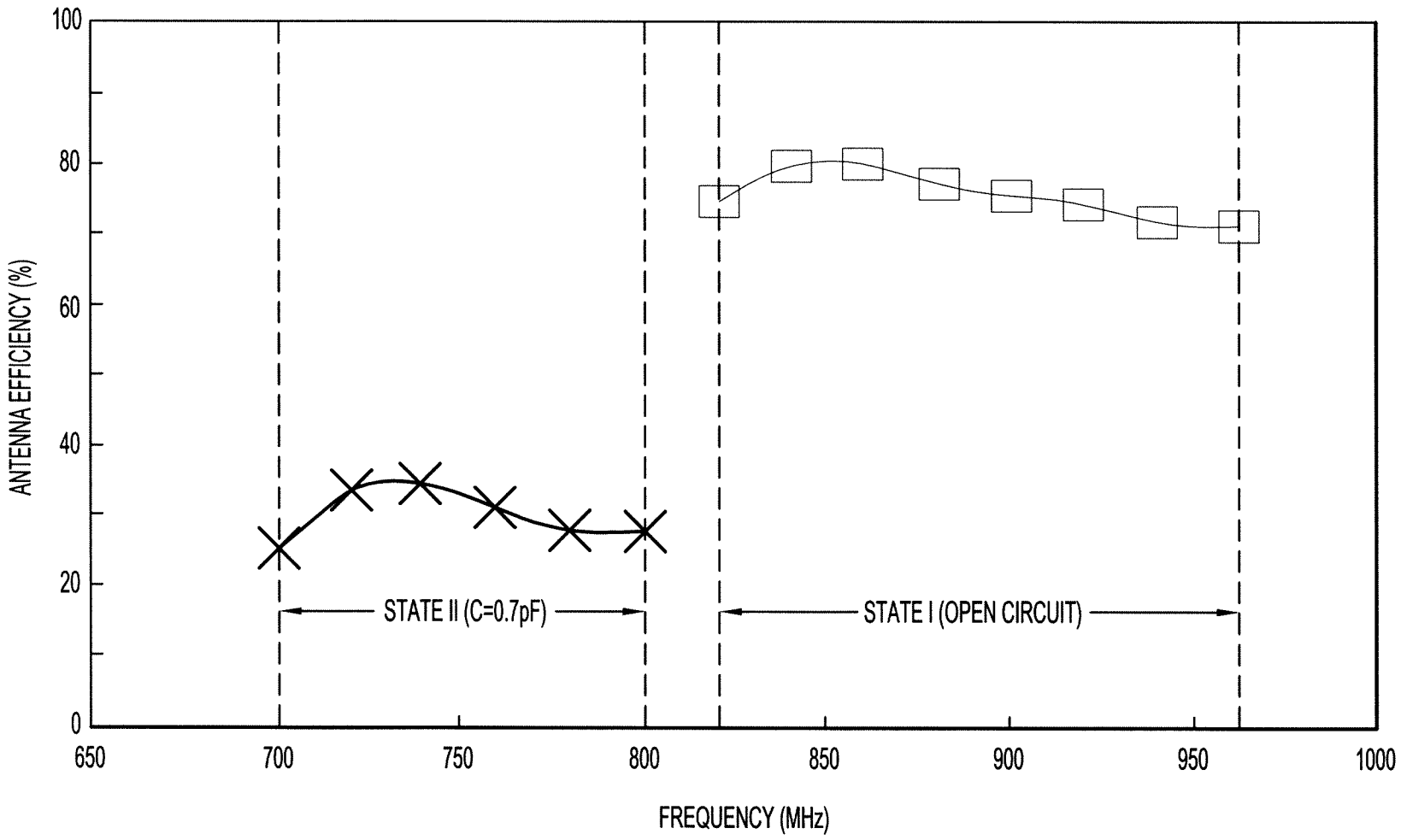

FIGS. 5A-5C are graphs depicting performance of a specific implementation of antenna 300. In the example embodiment, antenna 300 is designed around a 900 MHz carrier frequency ($\lambda_0$=333 mm, $\lambda_e$=153 mm) and designed to be used as an internal antenna of a handheld mobile communication device. Using the dimensions illustrated in FIGS. 3A and 3B, the internal mobile device antenna is sized to the following: lateral dimension X=60 mm ($0.18*\lambda_0=0.4*\lambda_e$), longitudinal dimension Y=110 mm ($0.33*\lambda_0=0.7*\lambda_e$), slot length L=39 mm ($0.12*\lambda_0=0.25*\lambda_e$), slot width W=4 mm ($0.012\lambda_0=0.03*\lambda_e$), offset from nearest lateral edge D=6 mm ($0.018*\lambda_0=0.04*\lambda_e$) and ground strap elevation height Z=5 mm ($0.015*\lambda_0=0.032*\lambda_e$). The exemplary mobile device antenna is tunable for GSM850/900 dual-band operation and GSM1800/1900/UMTS triple-band operation in one state of tuning circuit 320 and is tunable for LTE700 band operation in another state of tuning circuit 320. Accordingly, tuning element 1 corresponding to tuning circuit State I may be an open circuit and tuning element 2 corresponding to tuning circuit State II may be a 0.7 pF capacitor.

FIG. 5A is a graph of simulated return loss for the exemplary internal mobile device tunable antenna per the design described above and FIG. 5B is a graph of measured results of the same design. As illustrated in the figures, when the tuning circuit is in State I, the antenna's lower band impedance bandwidth encompasses GSM850/900 dual-band frequencies and the antenna's upper band impedance bandwidth encompasses GSM1800/1900/UMTS triple-band frequencies. In State II of the tuning circuit (C=0.7 pF), the antenna's lower band resonant mode is shifted to a lower frequency, i.e., about 700-800 MHz. In this state, the antenna's lower band impedance bandwidth encompasses LTE700 frequencies. It is to be noted that the simulation results illustrated in FIG. 5A and the actual measurements illustrated in FIG. 5B are in reasonable agreement. The measured antenna efficiency, which includes the impedance mismatch loss for the exemplary tunable antenna is illustrated in FIG. 5C. Over the desired GSM850/900 (State I, Open Circuit) and LTE700 (State II, C=0.7 pF) bands, the measured efficiency is 71%-80% and 25%-35%, respectively, which are acceptable for practical applications.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. An apparatus, comprising:

an antenna, comprising a slot radiator formed in a planar conductor and having an open and a closed end, the planar conductor having a top edge, a first side edge including the open end of the slot, and a second side edge opposite to the first side edge;

a grounding strap comprising a first segment disposed parallel to the slot along the top edge between the first edge and the second edge, a second segment disposed along the second edge, and a third segment extending from the second edge toward the first edge and parallel to both the top edge and the slot with a space between the first segment and the third segment, wherein the third segment is disposed exclusively in an area that is bounded by a line extending along a longitudinal edge of the slot nearest the top edge, the first segment, the first edge and the second edge; and a tuning circuit by which a resonant frequency of the antenna is selected, the tuning circuit being electrically coupled to the planar conductor at opposing sides of the slot and configured to select a circuit path from a plurality of circuit paths, wherein the tuning circuit is contained in a single containing region at the open end of the slot and comprises:

a switch circuit, comprising a control terminal by which a contact position of the switch is selected; and at least one circuit element connected between the switch circuit and the slot, wherein the circuit paths in the containing region connect the circuit element through the switch circuit to the opposing sides of the planar conductor, wherein the at least one circuit element comprises a reactive element of sufficient value to change a frequency band of operation of the antenna.

2. The apparatus of claim 1, wherein the containing region at the open end of the slot comprises a broadened region that is wider than the closed end of the slot and the switch circuit is located entirely in the broadened region.

3. The apparatus of claim 1, wherein the at least one circuit element comprises a plurality of circuit elements connected between the switch circuit and the slot and the circuit paths in the containing region connect a selected one of the circuit elements through the switch circuit to the opposing sides of the planar conductor.

4. The apparatus of claim 3, wherein the circuit elements comprise respective capacitors having a capacitance that is other than the capacitance of the capacitor in another of the sets of circuit elements.

5. The apparatus of claim 1, wherein the tuning circuit includes n open circuit selectable by the switch.

6. The apparatus of claim 1, wherein the antenna comprises:

a dielectric substrate on which the planar conductor is disposed, wherein the slot is formed in the conductor to expose the substrate and the open end of the slot is formed at an edge of the planar conductor and an edge of the substrate.

7. The apparatus of claim 6, wherein the slot is closer to one lateral edge of the planar conductor than to another lateral edge of the planar conductor.

8. The apparatus of claim 1, wherein the slot is a quarter-wavelength slot corresponding to a fixed resonant frequency.

9. The apparatus of claim 1, wherein the grounding strap is raised above the planar conductor.

10. The apparatus of claim 9, wherein the grounding strap is connected to the planar conductor at a grounding point.

11. The apparatus of claim 10, wherein the grounding point is at a same edge of the planar conductor as is the open end of the slot.

12. An apparatus, comprising:

an antenna, comprising a slot radiator, the slot having an open and a closed end formed in a planar conductor, the planar conductor having a top edge, a first side edge including the open end of the slot, and a second side edge opposite to the first side edge;

a grounding strap comprising a first segment disposed parallel to the slot along the top edge between the first edge and the second edge, a second segment disposed along the second edge, and a third segment extending from the second edge toward the first edge and parallel to both the top edge and the slot with a space between the first segment and the third segment wherein the third segment is disposed exclusively in an area that is bounded by a line extending along a longitudinal edge of the slot nearest the top edge, the first segment, the first edge and the second edge;

a tuning circuit by which a resonant frequency of the antenna is selected, the tuning circuit being electrically coupled to the planar conductor at opposing sides of the slot and configured to select a circuit path from a plurality of circuit paths formed in a single containing region of the antenna in accordance with a control signal provided thereto; and a communication circuit, coupled to the antenna to communicate wirelessly at a frequency corresponding to the resonant frequency, wherein the tuning circuit comprises:

a switch circuit, comprising a control terminal by which a circuit path through the switch is selected; and one or more sets of circuit elements, connected between the switch and the slot, each set of circuit elements modifying the resonant frequency band of the antenna in accordance with one of a plurality of selectable frequency bands.

13. The apparatus of claim 12, wherein the communication circuit generates the control signal in accordance with a selected frequency band.

14. The apparatus of claim 12, wherein each of the sets of circuit elements, when greater than one set of circuit elements, comprises a capacitor having a capacitance that is other than the capacitance of the capacitor in another of the sets of circuit elements.

15. The apparatus of claim 14, wherein the tuning circuit comprises an open circuit selectable by the switch.

16. The apparatus of claim 12, wherein the grounding strap is raised above the planar conductor.

17. The apparatus of claim 16 wherein the grounding strap is connected to the planar conductor at a grounding point.

18. The apparatus of claim 17, wherein the grounding point is at a same edge of the planar conductor as is the open end of the slot.

* * * * *